US005625251A

United States Patent [19]

Nosker et al.

[11] Patent Number: 5,625,251

[45] Date of Patent: Apr. 29, 1997

[54] UNIAXIAL TENSION FOCUS MASK FOR COLOR CRT AND METHOD OF MAKING SAME

[75] Inventors: Richard W. Nosker, Princeton; Joey J. Michalchuk, Lambertville; Dennis L. Matthies, Princeton, all of N.J.

[73] Assignee: Thomson Consumer Electronics, Inc., Indianapolis, Ind.

[21] Appl. No.: 509,321

[22] Filed: Jul. 26, 1995

[51] Int. Cl.[6] ..... H01J 9/18

[52] U.S. Cl. ..... 313/403; 445/37

[58] Field of Search ..... 445/37; 313/403, 313/408

[56] References Cited

U.S. PATENT DOCUMENTS

| | | | |
|---|---|---|---|
| 4,197,482 | 4/1980 | Koorneef et al. | 445/37 |
| 4,207,656 | 6/1980 | van Esdonk et al. | 445/37 |
| 4,374,452 | 2/1983 | Koorneef | 445/66 |
| 4,443,499 | 4/1984 | Lipp | 427/258 |
| 4,473,772 | 9/1984 | de Keijzer | 313/403 X |
| 4,621,214 | 11/1986 | Bloom et al. | 313/402 |
| 4,650,435 | 3/1987 | Tamutus | 445/47 |
| 5,045,010 | 9/1991 | Fairbanks | 445/30 |

FOREIGN PATENT DOCUMENTS 39-24981 11/1964 Japan .

*Primary Examiner*—Kenneth J. Ramsey
*Attorney, Agent, or Firm*—Joseph S. Tripoli; Dennis H. Irlbeck; Vincent J. Coughlin, Jr.

[57] ABSTRACT

A color cathode-ray tube 10 has an evacuated envelope 11 with an electron gun 26 therein for generating at least one electron beam 28. The envelope further includes a faceplate panel 12 having a luminescent screen 22 with phosphor lines on an interior surface thereof. A uniaxial tension focus mask 25, having a plurality of spaced-apart first metal strands 40, is located adjacent to an effective picture area of the screen 22. The spacing between the first metal strands 40 defines a plurality of slots 42 substantially parallel to the phosphor lines of the screen. Each of the first metal strands 40, across the effective picture area of the screen, has a substantially continuous first insulator layer 64 on a screen-facing side thereof. A second insulator layer 66 overlies the first insulator layer 64. A plurality of second metal strands 60 are oriented substantially perpendicular to the first metal strands 40 and are bonded thereto by the second insulator layer 66.

11 Claims, 3 Drawing Sheets

Fig. 2
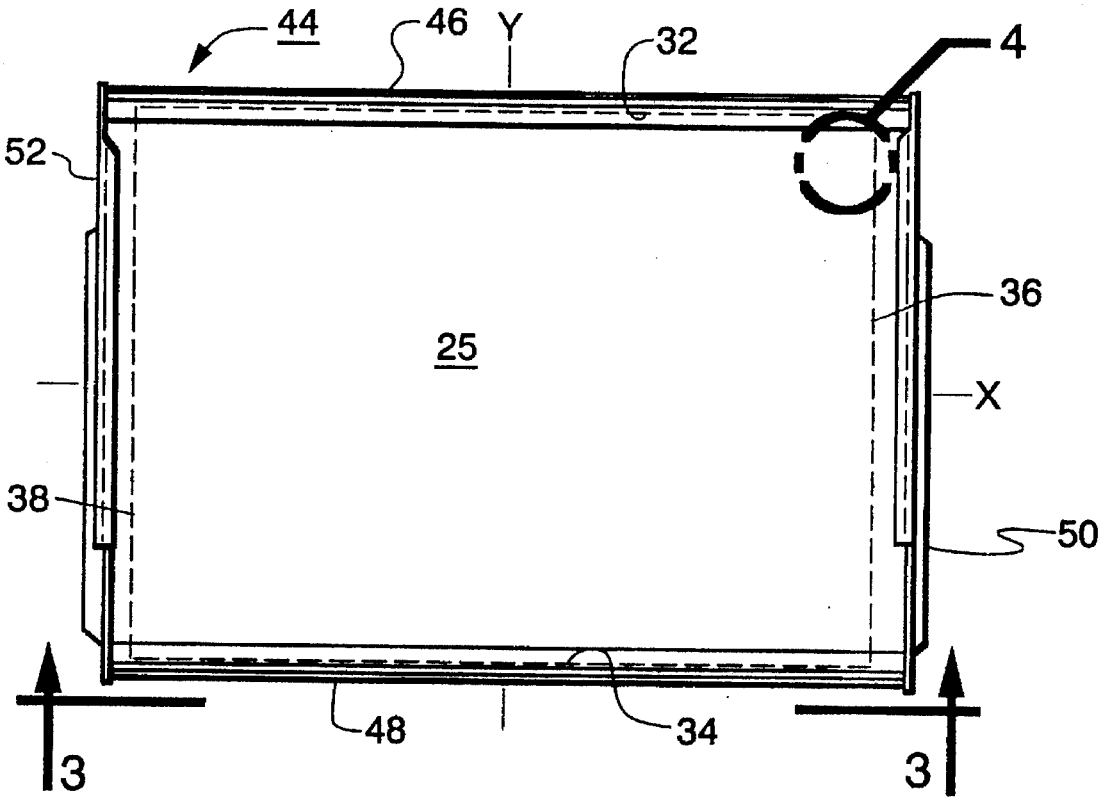
Fig. 3
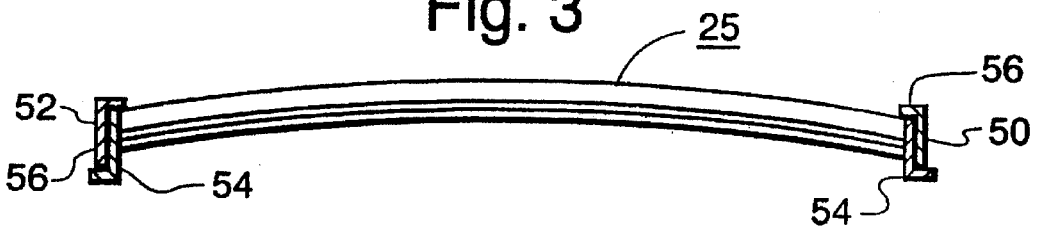
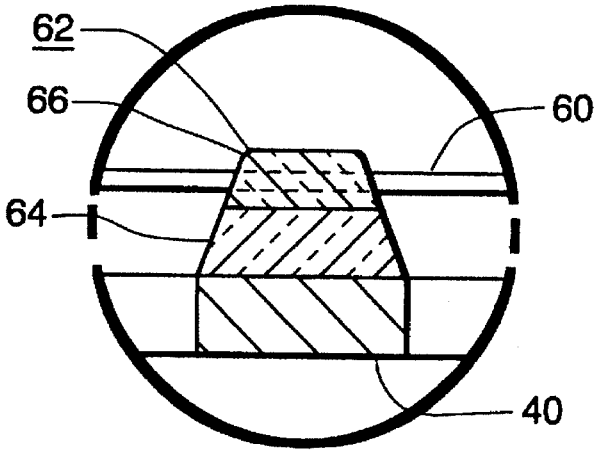
Fig. 6

UNIAXIAL TENSION FOCUS MASK FOR COLOR CRT AND METHOD OF MAKING SAME

This invention relates to a color cathode-ray tube (CRT) and, more particularly, to a color CRT having a uniaxial tension focus mask and to a method of making such a mask.

BACKGROUND OF THE INVENTION

A conventional shadow mask type color CRT generally comprises an evacuated envelope having therein a luminescent screen with phosphor elements of three different emissive colors arranged in color groups, in a cyclic order, means for producing three convergent electron beams directed towards the screen, and a color selection structure, such as a masking plate, between the screen and the beam-producing means. The masking plate acts as a parallax barrier that shadows the screen. The differences in the convergence angles of the incident electron beams permit the transmitted portions of the beams to excite phosphor elements of the correct emissive color. A drawback of the shadow mask type CRT is that the masking plate, at the center of the screen, intercepts all but about 18–22% of the beam current; that is, the masking plate is said to have a transmission of only about 18–22%. Thus, the area of the apertures in the plate is about 18–22% of the area of the masking plate. Since there are no focusing fields associated with the masking plate, a corresponding portion of the screen is excited by the electron beams.

In order to increase the transmission of the color selection electrode without increasing the size of the excited portions of the screen, post-deflection focusing color selection structures are required. The focusing characteristics of such structures permit larger aperture openings to be utilized to obtain greater electron beam transmission than can be obtained with the conventional shadow mask. One such structure is described in Japanese Patent Publication No. SHO 39 25981by Sony, published on Nov. 6, 1964. In that structure, mutually orthogonal lead wires are attached at their crossing points by insulators to provide large window openings through which the electron beams pass. One drawback of such a structure is that the cross wires offer little shielding to the insulators so that the deflected electron beams will strike and electrostatically charge the insulators. The electrostatically charged insulators will distort the paths of the electron beams passing through the window openings, causing misregister of the beams with the phosphor screen elements. Another drawback of the structure described in the Japanese patent is that mechanical breakage of an insulator would permit an electrical short circuit between the crossed grid wires. Another color selection electrode focusing structure that overcomes some of the drawbacks of the above-described Japanese patent Publication is described in U.S. Pat. No. 4,443,499, issued on Apr. 17, 1984 to Lipp. The structure described in U.S. Pat. No. 4,443,499 utilizes a masking plate having a thickness of about 0.15 mm (6 mils) with a plurality of rectangular apertures therethrough as the first electrode. Metal ridges separate the columns of apertures. The tops of the metal ridges are provided with a suitable insulating coating. A metallized coating overlies the insulating coating to form a second electrode that provides the required electron beam focusing when suitable potentials are applied to the masking plate and to the metallized coating. Alternatively, as described in U.S. Pat. No. 4,650,435, issued on Mar. 17, 1987 to Tamutus, a metal masking plate, which forms the first electrode, is etched from one surface to provide parallel trenches in which insulating material is deposited and built up to form insulating ridges. The masking plate is further processed by means of a series of photoexposure, development, and etching steps to provide apertures between the ridges of insulating material that reside on the support plate. Metallization on the tops of the insulating ridges forms the second electrode. The two U.S. Patents described above eliminate the problem of electrical short circuits between the spaced apart conductors that was a drawback in the prior Japanese structure; however, the apertured masking plates of the U.S. patents each have cross members of substantial dimension that reduce the electron beam transmission. Additionally, the thickness of the masking plates is such that deflected electrons will still impinge upon and electrostatically charge the ridges of insulating material. Thus, a need exists for a focus mask structure that overcomes the drawbacks of the prior structures.

SUMMARY OF THE INVENTION

The present invention relates to a color cathode-ray tube having an evacuated envelope with an electron gun therein for generating at least one electron beam. The envelope further includes a faceplate panel having a luminescent screen with phosphor lines on an interior surface thereof. A uniaxial tension focus mask, having a plurality of spaced-apart first metal strands, is located adjacent to an effective picture area of the screen. The spacing between the first metal strands defines a plurality of slots substantially parallel to the phosphor lines of the screen. Each of the first metal strands, across the effective picture area of the screen, has a substantially continuous first insulator layer on a screen-facing side thereof. A second insulator layer overlies the first insulator layer. A plurality of second metal strands are oriented substantially perpendicular to the first metal strands and are bonded thereto by the second insulator layer.

BRIEF DESCRIPTION OF THE DRAWINGS

The invention will now be described in greater detail, with relation to the accompanying drawings, in which:

FIG. 2 is a plan view of a uniaxial tension focus mask-frame assembly used in the CRT of FIG. 1;

FIG. 3 is a front view of the mask-frame assembly taken along line 3—3 of FIG. 2;

FIG. 6 is an enlarged view of a portion of the uniaxial tension focus mask within the circle 6 of FIG. 5.

DETAILED DESCRIPTION OF THE PREFERRED EMBODIMENT

Figure 1:
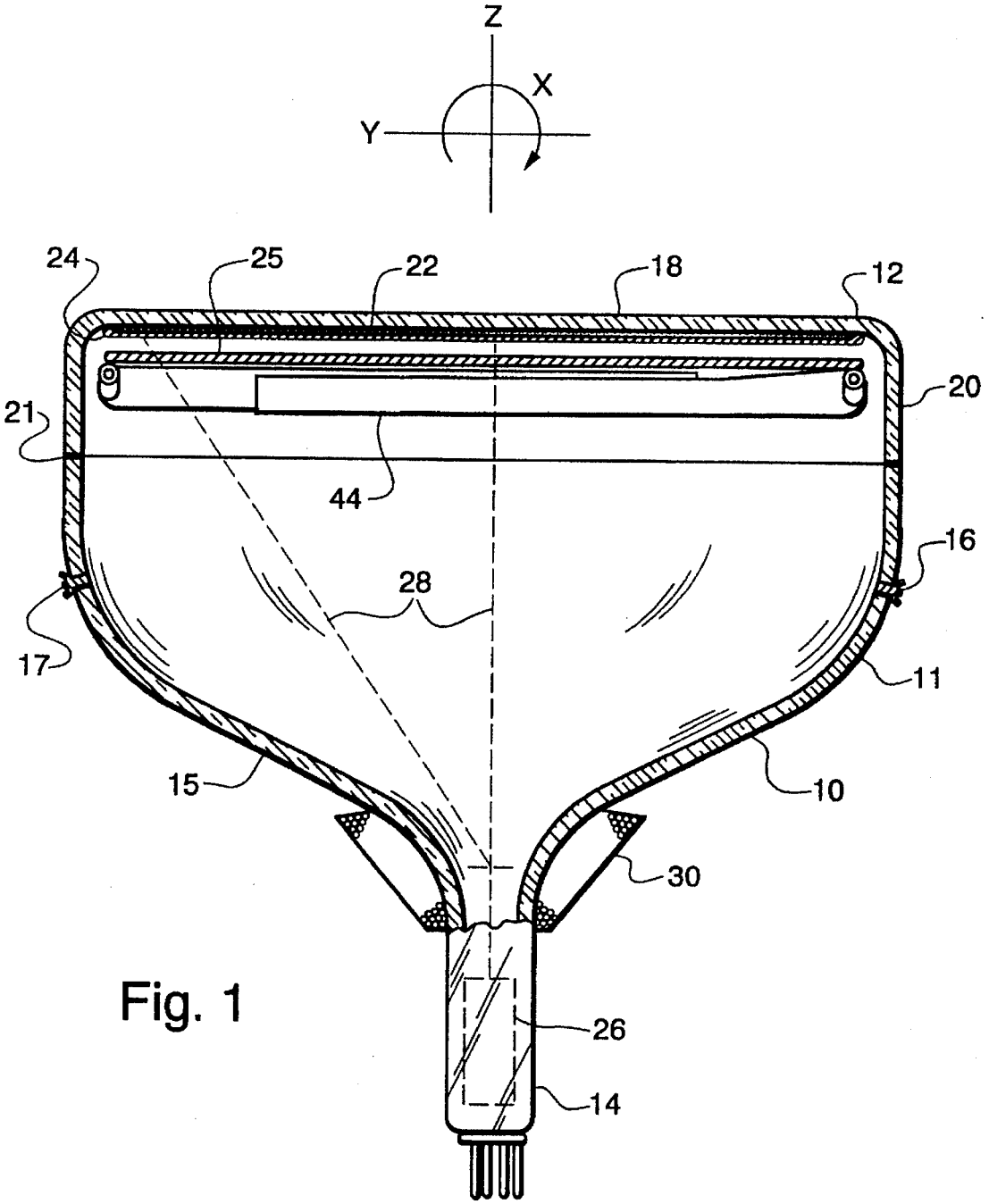
FIG. 1 is a plan view, partly in axial section, of a color CRT embodying the invention.

FIG. 1 shows a color CRT 10 having a glass envelope 11 comprising a rectangular faceplate panel 12 and a tubular neck 14 connected by a rectangular funnel 15. The funnel has an internal conductive coating (not shown) that is in contact with, and extends from, a first anode button 16 to the neck 14. A second anode button 17, located opposite the first anode button 16, is not contacted by the conductive coating. The panel 12 comprises a cylindrical viewing faceplate 18 and a peripheral flange or sidewall 20 that is sealed to the funnel 15 by a glass frit 21. A three-color luminescent phosphor screen 22 is carried by the inner surface of the faceplate 18. The screen 22 is a line screen, shown in detail in FIG. 5, that includes a multiplicity of screen elements comprised of red-emitting, green-emitting, and blue-emitting phosphor lines, R, G, and B, respectively, arranged in triads, each triad including a phosphor line of each of the three colors. Preferably, a light absorbing matrix 23 separates the phosphor lines. A thin conductive layer 24, preferably of aluminum, overlies the screen 22 and provides means for applying a uniform first anode potential to the screen as well as for reflecting light, emitted from the phosphor elements, through the faceplate 18. A cylindrical multi-apertured color selection electrode, or uniaxial tension focus mask, 25 is removably mounted, by conventional means, within the panel 12, in predetermined spaced relation to the screen 22. An electron gun 26, shown schematically by the dashed lines in FIG. 1, is centrally mounted within the neck 14 to generate and direct three inline electron beams 28, a center and two side or outer beams, along convergent paths through the mask 25 to the screen 22. The inline direction of the beams 28 is normal to the plane of the paper.

Figure 4:
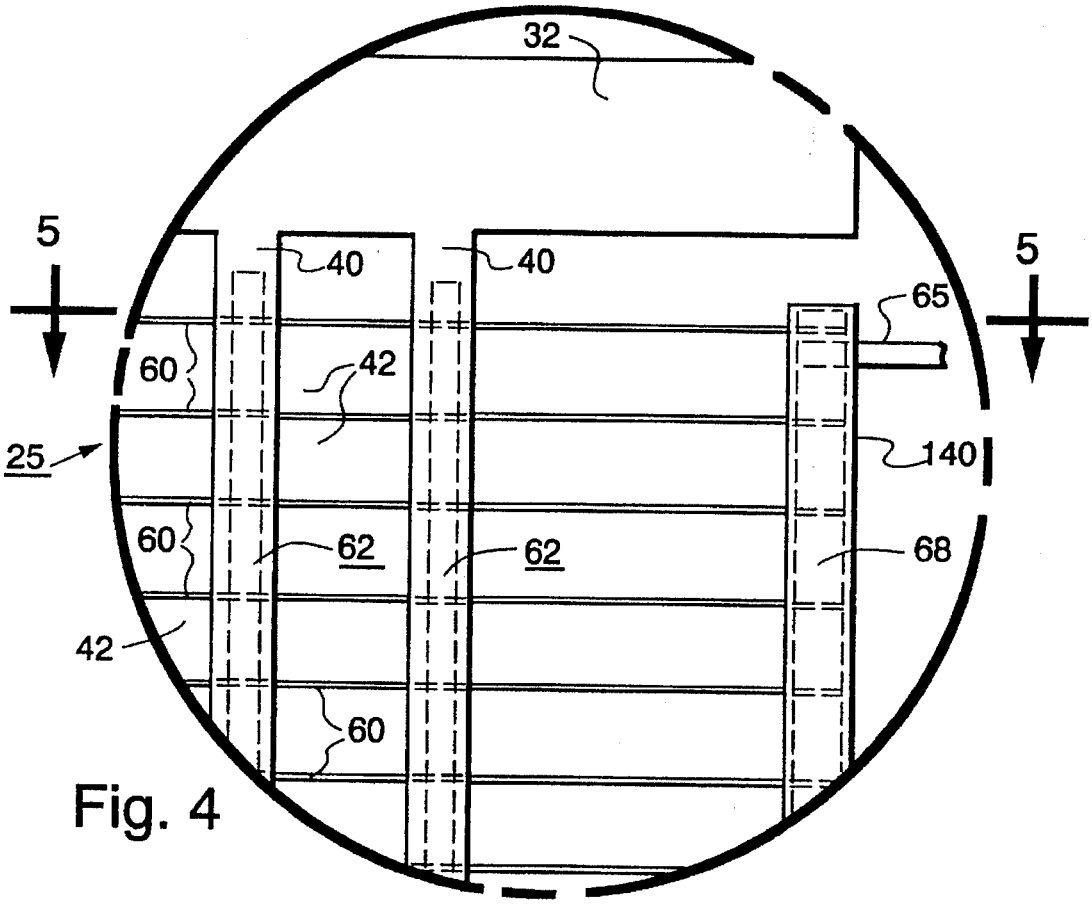
FIG. 4 is an enlarged section of the uniaxial tension focus mask shown within the circle 4 of FIG. 2.

The CRT of FIG. 1 is designed to be used with an external magnetic deflection yoke, such as the yoke 30, shown in the neighborhood of the funnel-to-neck junction. When activated, the yoke 30 subjects the three beams to magnetic fields that cause the beams to scan a horizontal and vertical rectangular raster over the screen 22. The uniaxial tension mask 25 is formed, preferably, from a thin rectangular sheet of about 0.05 mm (2 mil) thick low carbon steel, that is shown in FIG. 2 and includes two long sides 32, 34 and two short sides 36, 38. The two long sides 32, 34 of the mask parallel the central major axis, X, of the CRT and the two short sides 36, 38 parallel the central minor axis, Y, of the CRT. The steel has a composition, by weight, of about 0.005% carbon, 0.01% silicon, 0.12% phosphorus, 0.43% manganese, and 0.007% sulfur. Preferably, the ASTM grain size of the mask material is within the range of 9 to 10. The mask 25 includes an apertured portion that is adjacent to and overlies an effective picture area of the screen 22 which lies within the central dashed lines of FIG. 2 that define the perimeter of the mask 25. As shown in FIG. 4, the uniaxial tension focus mask 25 includes a plurality of elongated first metal strands 40, each having a transverse dimension, or width, of about 0.3 mm (12 mils) separated by substantially equally spaced slots 42, each having a width of about 0.55 mm (21.5 mils) that parallel the minor axis, Y, of the CRT and the phosphor lines of the screen 22. In a color CRT having a diagonal dimension of 68 cm (27 V), there are about 600 of the first metal strands 40. Each of the slot 42 extends from the long side 32 of the mask to the other long side 34, not shown in FIG. 4. A frame 44, for the mask 25, is shown in FIGS. 1–2 and includes four major members, two torsion tubes or curved members 46 and 48 and two tension arms or straight members 50 and 52. The two curved members, 46 and 48, parallel the major axis, X, and each other. As shown in FIG. 3, each of the straight members 50 and 52 includes two overlapped partial members or parts 54 and 56, each part having an L-shaped cross-section. The overlapped parts 54 and 56 are welded together where they are overlapped. An end of each of the parts 54 and 56 is attached to an end of one of the curved members 46 and 48. The curvature of the curved members 46 and 48 matches the cylindrical curvature of the uniaxial tension focus mask 25. The long sides 32, 34 of the uniaxial tension focus mask 25 are welded between the two curved members 46 and 48 which provide the necessary tension to the mask. Before welding to the frame 44, the mask material is pre-stressed and darkened by tensioning the mask material while heating it, in a controlled atmosphere of nitrogen and oxygen, at a temperature of about 500° C. for one hour. The frame 44 and the mask material, when welded together, comprise a uniaxial tension mask assembly.

Figure 5:
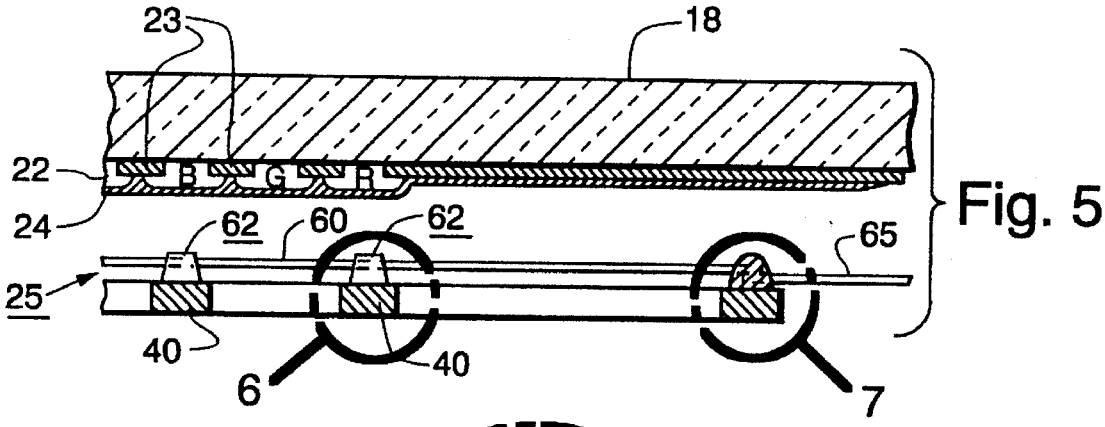
FIG. 5 is a section of the uniaxial tension focus mask and the luminescent screen taken along lines 5—5 of FIG. 4.

With reference to FIGS. 4 and 5, a plurality of second metal strands 60, each having a diameter of about 0.025 mm (1 mil), are disposed substantially perpendicular to the first metal strands 40 and are spaced therefrom by an insulator 62 formed on the screen-facing side of each of the first metal strands. The second metal strands 60 form cross members that facilitate applying a second anode, or focusing, potential to the mask 25. The preferred material for the second metal strands is HyMu80 wire, available from Carpenter Technology, Reading, Pa. The vertical spacing, or pitch, between adjacent second strands 60 is about 0.41 mm (16 mils). Unlike the cross members described in the prior art that have a substantial dimension that significantly reduces the electron beam transmission of the masking plate, the relatively thin second metal strands 60 provide the essential focusing function to the present uniaxial focus tension mask 25 without adversely affecting the electron beam transmission thereof. The uniaxial tension focus mask 25, described herein, provides a mask transmission, at the center of the screen, of about 60%, and requires that the second anode, or focusing, voltage, AV, applied to second strands 60, differs from the first anode voltage applied to the first metal strands 40 by less than about 1 kV, for a first anode voltage of about 30 kV.

The insulators 62, shown in FIGS. 4 and 5, are disposed substantially continuously on the screen-facing side of each of the first metal strands 40. The second metal strands 60 are bonded to the insulators 62 to electrically isolate the second metal strands 60 from the first metal strands 40.

The method of making the uniaxial tension focus mask 25 includes providing, e.g., by spraying, a first coating of an insulative, devitrifying solder glass onto the screen-facing side of the first metal strands 40. A suitable solvent and an acrylic binder are mixed with the devitrifying solder glass to give the first coating a modest degree of mechanical strength. The first coating has a thickness of about 0.14 mm. The frame 44, to which the first metal strands 40 are attached, is placed into an oven and the first coating is dried at a temperature of about 80° C. A devitrifying solder glass is one that melts at a specific temperature to form a crystallized glass insulator. The resultant crystallized glass insulator is stable and will not remelt when reheated to the same temperature. After drying, the first coating is contoured so that it is shielded by the first metal strands 40 to prevent the electron beams 28, passing thought the slots 42, from impinging upon the insulator and charging it. The contouring is performed on the first coating by abrading or otherwise removing any of the solder glass material of the first coating that extends beyond the edge of the strands 40 and would be contacted by either the deflected or undeflected electron beams 28. The first coating is entirely removed, by modest mechanical action, from the initial and ultimate, i.e., the right and left first metal strands, hereinafter designated the first metal end strands 140, before the first coating is heated to the sealing temperature. The first metal end strands 140, which are outside of the effective picture area, subsequently will be used as busbars to address the second metal strands 60. To further ensure the electrical integrity of the uniaxial tension focus mask 25, at least one additional first metal strand 40 is removed between the first metal end strands 140 and the first metal strands 40 that overlie the effective picture area of the screen to minimize the possiblity of a short circuit. Thus, the right and left first metal end strands 140, outside the effective picture area, are spaced from the first metal strands 40 that overlie the picture area by a distance of at least 1.4 mm (55 mils), which is greater than the width of the equally spaced slots 42 that separate the first metal strands 40 across the picture area.

The frame 44 with the first metal strands 40 and the end strands 140 attached thereto (hereinafter referred to as the assembly) is placed into an oven and heated in air. The assembly is heated over a period of 30 minutes to a temperature of 300° C. and held at 300° C. for 20 minutes. Then, over a period of 20 minutes, the temperature of the oven is increased to 460° C. and held at that temperature for one hour to melt and crystallize the first coating to form a first insulator layer 64 on the first metal strands 40, as shown in FIG. 6. The resultant first insulator layer 64, after firing, has a thickness within the range of 0.5 to 0.9 mm (2 to 3.5 mils) across each of the strands 40. The preferred solder glass for the first coating is a lead-zinc-borosilicate devitrified solder glass that melts in the range of 400° to 450° C. and is commercially available, as SCC-11, from a number of glass suppliers, including SEM-COM, Toledo, Ohio, and Corning Glass, Corning, N.Y.

Next, a second coating of a suitable insulative material, mixed with a solvent, is applied, e.g., by spraying, to the first insulator layer 64. Preferably, the second coating is a non-devitrifying (i.e., vitreous) solder glass having a composition of 80 wt. % PbO, 5 wt % ZnO, 14 wt. % $B_2O_3$, 0.75 wt. % $SnO_2$, and, optionally, 0.25 wt. % CoO. A vitreous material is preferred for the second coating because when it melts, it will fill any voids in the surface of the first insulator layer 64 without adversely affecting the electrical and mechanical characteristics of the first layer. Alternatively, a devitrifying solder glass may be used to form the second coating. The second coating is applied to a thickness of about 0.025 to 0.05 mm (1 to 2 mils). The second coating is dried at a temperature of 80° C. and contoured, as previously described, to remove any excess material that could be struck by the electron beams 28.

Figure 7:
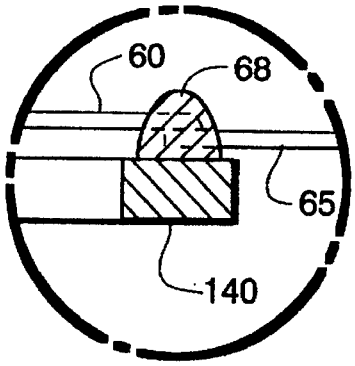
FIG. 7 is an enlarged view of another portion of the uniaxial tension focus mask within the circle 7 of FIG. 5.

As shown in FIGS. 4, 5 and 7, a thick coating of a devitrifying solder glass containing silver, to render it conductive, is provided on the screen-facing side of the left and right first metal end strands 140. A conductive lead 65, formed from a short length of nickel wire, is embedded into the conductive solder glass on one of the first metal end strands. Then, the assembly, having the dried and contoured second coating overlying the first insulator layer 64, has the second metal strands 60 applied thereto so that the second metal strands overlie the second coating of insulative material and are substantially perpendicular to the first metal strands 40. The second metal strands 60 are applied using a winding fixture, not shown, that accurately maintains the desired spacing of about 0.41 mm between the adjacent second metal strands. The second metal strands 60 also contact the conductive solder glass on the first metal end strands 140. Alternatively, the conductive solder glass can be applied at the junction between the second metal strands 60 and the first metal end strands 140 during, or after, the winding operation. Next, the assembly, including the winding fixture, is heated for 7 hours to a temperature of 460° C. to melt the second coating of insulative material, as well as the conductive solder glass, to bond the second metal strands 60 within both a second insulator layer 66 and a glass conductor layer 68. The second insulator layer 66 has a thickness, after sealing, of about 0.013 to 0.025 mm (0.5 to 1 mil). The height of the glass conductor layer 68 is not critical, but should be sufficiently thick to firmly anchor the second metal strands 60 and the conductive lead 65 therein. The portions of the second metal strands 60 extending beyond the glass conductor layer 68 are trimmed to free the assembly from the winding fixture.

The first metal end strands 140 are severed at the ends adjacent to top portion 32, shown in FIG. 4, and bottom portion 34 (not shown) of the mask 25 to provide a 1.5 gaps of about 0.4 mm (15 mils) therebetween that electrically isolate the first metal end strands 140 and forms busbars that permit a second anode voltage to be applied to the second metal strands 60 when the conductive lead 65, embedded in the glass conductor layer 68, is connected to the second anode button 17.

What is claimed is:

1. A color cathode-ray tube comprising an evacuated envelope having therein an electron gun for generating at least one electron beam, a faceplate panel having a luminescent screen with phosphor lines on an interior surface thereof, and a uniaxial tension focus mask having a plurality of spaced-apart first metal strands which are adjacent to an effective picture area of said screen and define a plurality of slots substantially parallel to said phosphor lines, each of said first metal strands across said effective picture area having a substantially continuous first insulator layer on a screen-facing side thereof, a second insulator layer overlying said first insulator layer, and a plurality of second metal strands oriented substantially perpendicular to said first metal strands, said second metal strands being bonded by said second insulator layer.

2. A color cathode-ray tube comprising an evacuated envelope having therein an electron gun for generating three electron beams, a faceplate panel having a luminescent screen with phosphor lines on an interior surface thereof, and a uniaxial tension focus mask in proximity to said screen, said tension focus mask having two long sides with a plurality of transversely spaced-apart first metal strands extending therebetween, the space between adjacent first metal strands defining substantially equally spaced slots parallel to said phosphor lines of said screen, said long sides of said mask being secured to a substantially rectangular frame having two long sides and two short sides, each of said first metal strands across an effective picture area of said screen having a substantially continuous first insulator layer on a screen-facing side thereof, a second insulator layer overlying said first insulator layer, and a plurality of second metal strands oriented substantially perpendicular to said first metal strands, said second metal strands being bonded by said second insulator layer.

3. The tube as described in claim 2, wherein said first insulator layer is a devitrifying solder glass.

4. The tube as described in claim 3, wherein said devitrifying solder glass is contoured to be shielded by said first metal strands from said electron beams.

5. The tube as described in claim 4, wherein said second insulator layer is a solder glass.

6. The tube as described in claim 5, wherein said solder glass is contoured to be shielded by said first metal strands from said electron beams.

7. The tube as described in claim 5, wherein said solder glass is vitreous.

8. The tube as described in claim 5, wherein said solder glass is devitrifying.

9. A method of making a uniaxial focus tension mask for a color cathode ray tube having an electron gun which generates and directs three electron beams through openings in said uniaxial focus tension mask to a luminescent screen, including the steps of:

securing a uniaxial tension mask to a substantially rectangular frame having two long sides and two short sides, said uniaxial tension mask having two long sides with a plurality of transversely spaced-apart first metal strands extending therebetween, the space between adjacent first strands defining parallel slots, said long sides of said mask being attached to the long sides of said frame, said frame applying tension to said first metal strands of said mask, forming an insulator on a major surface of said first metal strands facing said screen, across an effective picture area thereof, said insulator being substantially continuous on each of said first metal strands, and providing a plurality of second metal cross-strands secured to said insulator formed on each of said first metal strands to form said uniaxial tension focus mask.

10. The method as described in claim 9, wherein the step of forming said insulator includes the substeps of:

providing a first coating of a suitable insulative material onto each said first metal strands, across said effective picture area of said screen, contouring said first coating of insulative material to remove any of said insulative material from of each strand that would be impinge upon by said electron beams, to prevent charging thereof, and heating said first coating of said insulative material to form a substantially continuous first insulator layer.

11. The method as described in claim 10, wherein the step of attaching the cross-strands includes the substeps of:

applying a second coating of a suitable insulative material over said first insulator layer;

contouring said second coating of said insulative material to remove any of said second coating of said insulative material that would be impinged upon by said electron beam to prevent charging thereof, and heating said second coating of said insulative material, after said cross strands are positioned, to form a second insulator layer that bonds said cross strands in place.

* * * * *